US011465035B2

(12) United States Patent
Fustino

(10) Patent No.: US 11,465,035 B2
(45) Date of Patent: Oct. 11, 2022

(54) NESTING CHESS SET

(71) Applicant: Etho LLC, San Diego, CA (US)

(72) Inventor: David J. Fustino, San Diego, CA (US)

(73) Assignee: ETHO LLC, San Diego, CA (US)

( * ) Notice: Subject to any disclaimer, the term of this patent is extended or adjusted under 35 U.S.C. 154(b) by 157 days.

(21) Appl. No.: 16/941,009

(22) Filed: Jul. 28, 2020

(65) Prior Publication Data

US 2021/0205695 A1 Jul. 8, 2021

Related U.S. Application Data

(60) Provisional application No. 62/958,633, filed on Jan. 8, 2020.

(51) Int. Cl.
*A63F 3/00* (2006.01)

(52) U.S. Cl.
CPC .... *A63F 3/00697* (2013.01); *A63F 2003/007* (2013.01); *A63F 2003/00738* (2013.01); *A63F 2003/00817* (2013.01); *A63F 2003/00839* (2013.01)

(58) Field of Classification Search
CPC ..... A63F 3/00697; A63F 2003/007; A63F 2003/00738; A63F 2003/00817; A63F 2003/00839; A63F 2003/00716; A63F 3/02
See application file for complete search history.

(56) References Cited

U.S. PATENT DOCUMENTS

| | | | | |
|---|---|---|---|---|
| D211,590 | S * | 7/1968 | Watson | D21/389 |
| 3,806,128 | A * | 4/1974 | Endfield | A63F 3/00697 273/290 |
| D277,015 | S * | 1/1985 | Elliott | D21/389 |
| 6,352,262 | B1 * | 3/2002 | Looney | A63F 3/00697 273/288 |
| 7,178,804 | B1 * | 2/2007 | Traylor | A63F 3/00697 273/288 |
| 9,010,759 | B2 * | 4/2015 | McDonnell | A63F 9/00 273/342 |
| 2011/0049804 | A1 * | 3/2011 | Lockyear | A63F 3/02 273/260 |

* cited by examiner

*Primary Examiner* — Michael D Dennis
(74) *Attorney, Agent, or Firm* — Prince Lobel Tye LLP

(57) ABSTRACT

A nesting chess set with two teams of chess pieces. Each team includes one king, one queen, two rooks, two bishops, two knights, and eight pawns. The pieces of each team are configured such that they can be organized into two nests, each nest comprising eight pieces, wherein the only difference between the two nests is that one has the king and one has the queen, while otherwise each nest has a rook, a bishop, a knight, and four pawns. The queen is the outside piece of one nest. The king is the outside piece of the other nest. The rest of the pieces are sized and shaped to nest within the king or queen. Each nest is held together by a magnetic base.

17 Claims, 5 Drawing Sheets

NESTING CHESS SET

CROSS-REFERENCE TO RELATED APPLICATION

This application claims priority of provisional patent application 62/958,633 filed on Jan. 8, 2020.

BACKGROUND

This disclosure relates to a nesting chess set.

In the game of chess there are two opposing teams. Each team has sixteen playing pieces consisting of one king, one queen, two rooks, two bishops, two knights, and eight pawns. The general sizes and shapes of the pieces are well known.

SUMMARY

In the present disclosure the chess set pieces are configured such that the playing pieces of a team can be organized into two nests, each nest comprising eight pieces. The only difference between the two nests is that one has the king and one has the queen. Otherwise each nest has a rook, a bishop, a knight, and four pawns. The queen or king is the outside piece of one of the nests, and the rest of the pieces are sized and shaped to nest within the king or queen. In an example all eight pieces nest one within the other. Each nest is held together by a magnetic base member. The magnetic base members of the two nests are configured such that they attract to each other such that the two nests (i.e., the entire team) are held together end-to-end in an almost tubular team shape. The team can then be readily stored and transported, for example in a tubular container. The container can be configured to hold both teams.

In an example, inside of the king or queen the pieces are nested in the following order (from outermost to innermost): one bishop, one knight, one rook, and four identical pawns, for a total of eight pieces per nested stack. Each piece has a generally conical shape, with an open base and either an open or closed top. The conical shapes are arranged such that the pieces nest very closely together. In an example the nest is configured such that the bottoms of the annular bases of the king or queen, the bishop, the knight, and the rook, are all coplanar. In an example the nest is configured such that the bottom of the annular base of one pawn sits below the plane in which the bottoms of the bases of the king or queen, the bishop, the knight, and the rook sit. In an example the four pawns are stacked one on top of another and the entire stack sits in part inside of the rook, with the bottom of the base of the innermost pawn located lower than the base of the rook. In an example the rook, the knight and the bishop all have open tops so that the stack of four pawns can extend entirely through the lengths of the rook, knight, and bishop.

In an example the magnetic base member is similar to a pot magnet, with a permanent magnet encased in a steel shell. In an example the magnet is annular and the steel shell is cup shaped. The bases of the king or queen, the bishop, the knight, and the rook can sit on or just above a top surface of the magnet. The base of the lowermost pawn can sit inside of the magnet annulus. In an example a metal cap covers the top of the magnet and the exposed part of the shell inside of the magnet's annulus. The base of the lowermost pawn can sit on the metal cap. In an example the shell and cap can act as a magnetic circuit to help keep the magnetic field primarily in the shell and cap. In an example the king or queen is configured to sit directly on the top ends of the shell, the bishop, knight and rook are configured to sit directly on the cap directly above the top of the magnet, and the lowermost/innermost pawn is configured to sit directly on the cap on the inside of the magnet.

All examples and features mentioned below can be combined in any technically possible way.

In one aspect, a nesting chess set includes two teams of chess pieces. Each team includes one king, one queen, two rooks, two bishops, two knights, and eight pawns. The pieces of each team are configured such that they can be organized into two nests, each nest comprising eight pieces, wherein the only difference between the two nests is that one has the king and one has the queen, while otherwise each nest has a rook, a bishop, a knight, and four pawns. The queen is the outside piece of one nest. The king is the outside piece of the other nest. The rest of the pieces are sized and shaped to nest within the king or queen. Each nest is held together by a magnetic base.

Some examples include one of the above and/or below features, or any combination thereof. In an example the magnetic bases of the two nests are configured such that they attract to each other such that the two nests are configured to be held together end-to-end in a generally tubular team shape. In an example inside of the king and queen the pieces are nested in the following order from outside to inside: one bishop, one knight, one rook, and four pawns. In an example each piece has a generally conical shape, with an open base and either an open or closed top, wherein the conical shapes are constructed and arranged such that the pieces nest very closely together. In an example the four pawns are stacked one on top of another and the stack of pawns sits in part inside of the rook, with the bottom of the base of the innermost pawn located lower than the bottom of the base of the rook. In an example the magnetic base is generally circular. In an example the magnetic base comprises a generally annular magnet.

Some examples include one of the above and/or below features, or any combination thereof. In some examples a nest is configured such that the bottoms of the annular bases of the king or queen, the bishop, the knight, and the rook, are all generally coplanar. In an example the nest is configured such that the bottom of the annular base of one pawn sits below the plane in which the bottoms of the bases of the king or queen, the bishop, the knight, and the rook sit. In some examples the magnetic base comprises a permanent magnet at least partially encased in a shell made of a ferromagnetic material, wherein the magnet is annular and the shell is cup shaped. In an example the bottoms of the bases of the king or queen, the bishop, the knight, and the rook are configured to sit on or just above a top surface of the magnet, and wherein the base of the innermost pawn sits inside of the magnet annulus. In an example a metal cap covers the top of the magnet and the exposed part of the shell inside of the magnet's annulus. In an example the bottom of the base of the lowermost pawn is configured to sit on the metal cap. In an example the shell and cap are configured to act as a magnetic circuit to help keep the magnetic field primarily in the shell and cap. In an example the king or queen is configured to sit directly on the top outer edge of a shell, the bishop, knight and rook are configured to sit directly on the cap directly above the top of the magnet, and the innermost pawn is configured to sit directly on the cap on the inside of the magnet's annulus.

In another aspect a nesting chess set includes a plurality of chess pieces comprising a king, a rook, a bishop, a knight, and a pawn, wherein each chess piece defines a generally hollow conical shape, and the chess pieces are sized and shaped to nest one inside another, into a single stack. In an example the nesting chess set further comprises a base member that is constructed and arranged to support the single stack. In an example the base member is magnetic. In an example the bishop, the knight, and the rook, are each generally frustoconical, with an open top. In an example the pawn has a top end, and the king comprises an opening at a top thereof and that is constructed and arranged to fit the top end of the pawn therethrough.

BRIEF DESCRIPTION OF THE DRAWINGS

A non-limiting preferred embodiment of the nesting chess set is depicted in the drawings, wherein.

DETAILED DESCRIPTION

The present chess set includes a number of chess pieces, including a king, a rook, a bishop, a knight, and a pawn for one team, and a queen, a rook, a bishop, a knight, and a pawn for a second team. Each chess piece defines a generally hollow conical shape. The chess pieces are sized and shaped to nest one inside another, into a single stack. The chess set also includes a base member that is constructed and arranged to support both stacks. Alternatively the base member can support one stack. In an example the base member is magnetic. In an example the bishop, the knight, and the rook, are each generally frustoconical, with an open top. In an example the pawn has a top end, and the king and queen each comprise an opening at a top thereof and that is constructed and arranged to fit the top end of a pawn therethrough.

Figure 1:
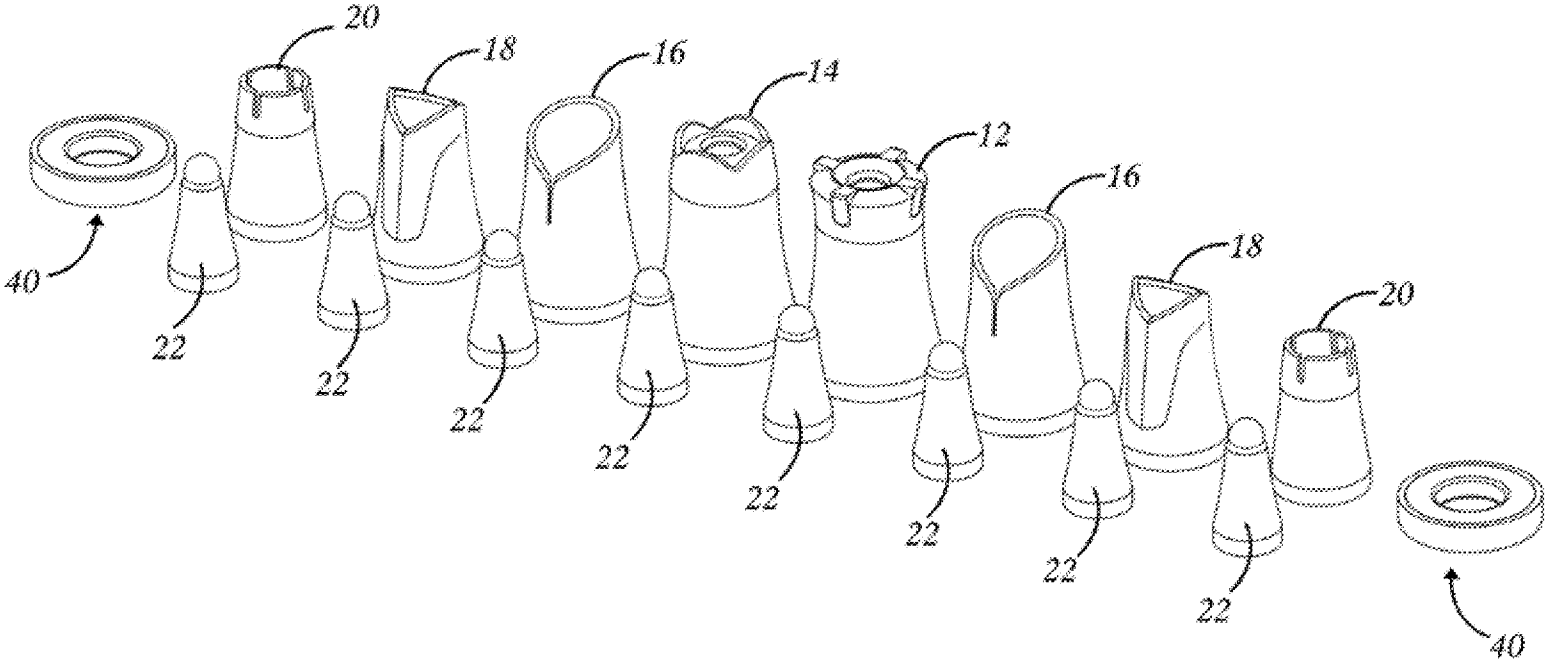
FIG. 1 is an isometric front view of all of the pieces of a chess team (there being six unique pieces of a chess team, plus the two bases), where the unique pieces are the king, queen, bishop, knight, rook, and pawn. A team includes sixteen pieces—the king, queen, two each of the bishop, knight, and rook, and eight pawns. The bases are used to store the pieces of a team in a nested configuration.
Figure 2:
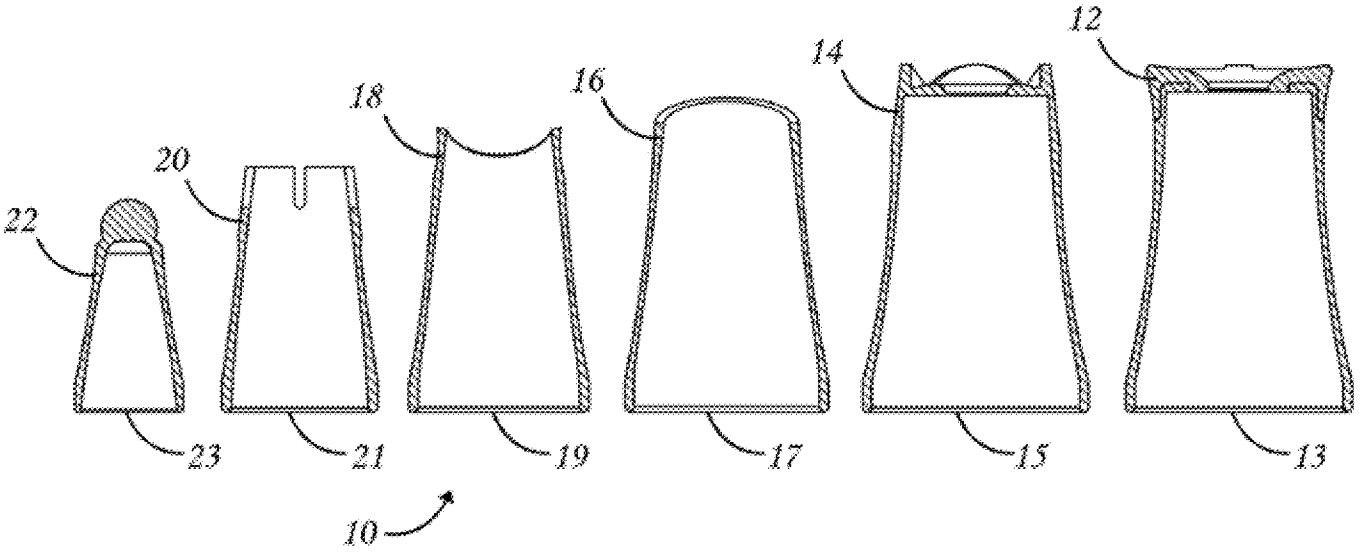
FIG. 2 is a cross-sectional view of each of the unique pieces of the chess team shown in FIG. 1.
Figures 3A, 3B, 5A, 5B:
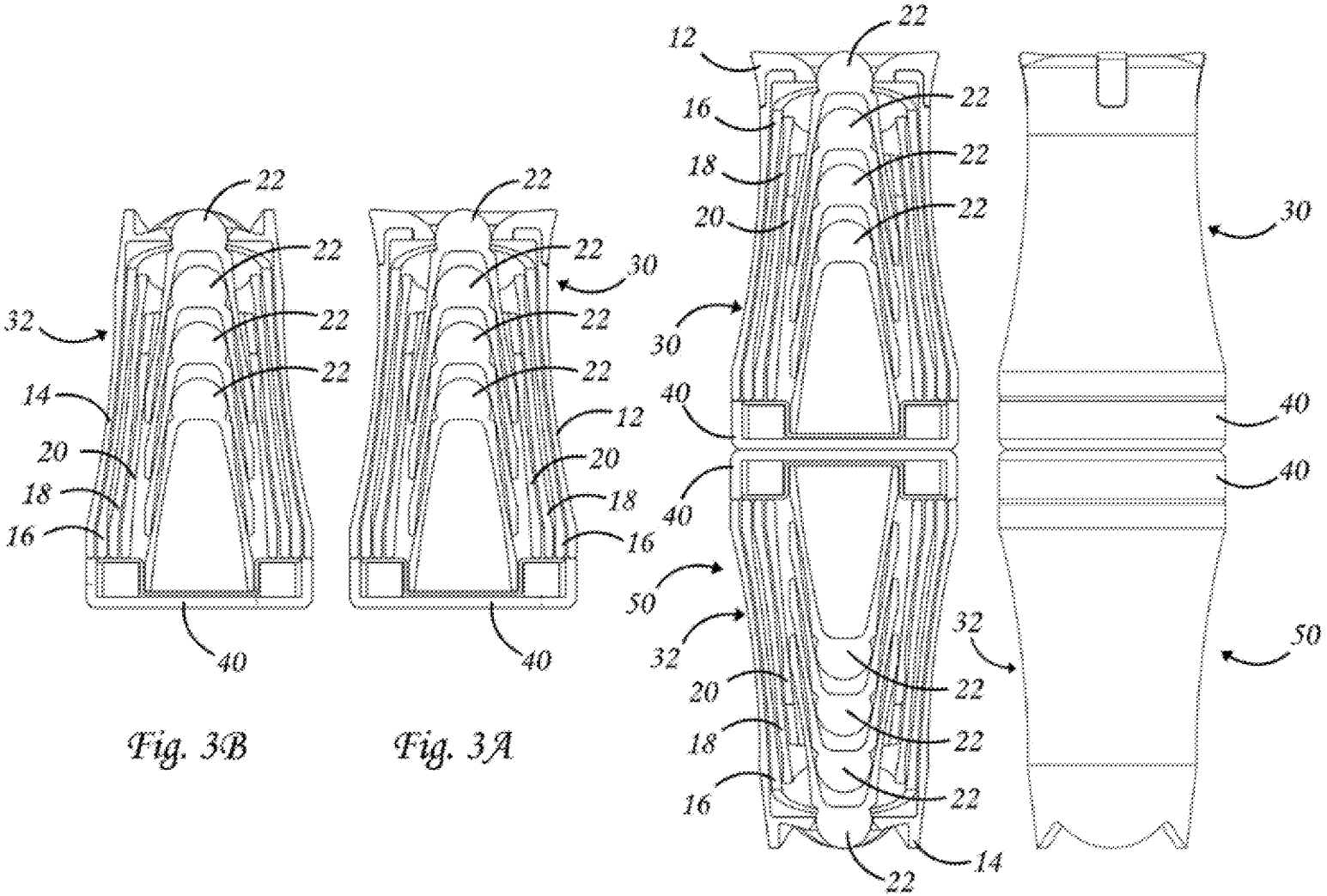
FIGS. 3A and 3B are cross-sectional views of the two stacks for a team.
FIGS. 5A and 5B show a barrel (external and cross-sectional views, respectively) consisting of the two stacks for a team magnetically held together back-to-back.

FIG. 1 is an isometric front view illustrating the six unique pieces of a chess team 10, where the unique pieces are the king 12, queen 14, bishop 16, knight 18, rook 20, and pawn 22. A team includes sixteen pieces—the king, queen, two each of the bishop, knight, and rook, and eight pawns. FIG. 2 is a cross-sectional view of the six unique pieces of FIG. 1, illustrating the relative dimensions and the tapers that allow the pieces to be nested, as shown in FIGS. 3A and 3B which are cross-sectional views of the two stacks for a team. King 12 has bottom edge 13, queen 14 has bottom edge 15, bishop 16 has bottom edge 17, knight 18 has bottom edge 19, rook 20 has bottom edge 21, and pawn 22 has bottom edge 23.

All the chess pieces (king, queen, bishop, knight, rook, pawn) are made of a steel or another material that is ferrous and so will be inherently drawn to the magnet of the base member. Or the pieces can be made of any other material (such as plastic) and include a base or base portion that is magnetic so it can be magnetically attracted to the base member. The pieces are placed one-by-one on the base member. Or the four pawns can be stacked and then placed as a stack on the base member. This is helpful for the pawns especially; the magnetic charge has a slight pull on each pawn so they do not fall or tip from the stack too easily.

Each piece has a unique cross section that allows it to stack over the part "inside" of it and nest underneath the part "above" it. See nested stacks 30 (with king 12 on the outside) and 32 (with queen 14 on the outside), FIGS. 3A and 3B, respectively. The inside and outside shape of each piece is configured so that they all stack as closely in diameter/width as they can. It is helpful to have good proportions and hierarchy in chess. This dictates the height as well. For example, the king and queen are about the same height and have about the same base diameter. The bishop is shorter and has a smaller base diameter than both the king and queen. The knight is shorter and has a smaller base diameter than the bishop, the king, and the queen. The rook is shorter and has a smaller base diameter than the knight, the bishop, the king, and the queen. The pawns are all the same, and they all are shorter than and have a smaller base diameter than the rook, the bishop, the king, and the queen. See FIG. 2. The set thus visually maintains a respectable height to width ratio comparable to the pieces of traditional chess sets. The base diameters of the pieces are controlled such that the king and queen's bases are not too big and the pawns' not too small, with the bases of the rest of the pieces between these two. From the base, each piece has a tapered appearance that is in part dictated by the part above or below it in the stacked/nested position. In an example the outside of the taper is slightly concave. In an example the cross-section has an uneven wall thickness through the flaring tapers of the pieces, in part to help minimize each piece's diameter from bottom to top.

Figure 4:
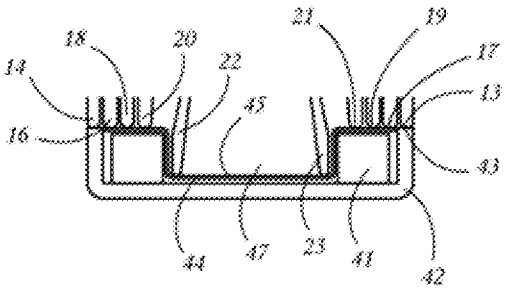
FIG. 4 is a partial enlarged cross-sectional view of the bases of five of the pieces coupled to a magnetic base member.

FIG. 4 is a partial enlarged cross-sectional view of the bottoms of the bases of the pieces that sit on and so are magnetically coupled to a magnetic base member. The base member can have a desired shape and size. Since all of the pieces have a round base, the base member is preferably round and has a diameter that is equal to the outside diameters of the king and queen, so that the bases of the king and queen sit flush on the outer edge of the base member. In an example, base member 40 includes a ceramic permanent magnet 41 inside a nickel plated steel base 42 that is cup shaped. There is a stamped metal cap 44 over the top. An optional decorative flocking layer 45 can be applied over the cap. The annular ceramic magnet 41 is under the steel cap such that the magnetic force travels through the cap and draws each part to the surface of the cap. Central area 47 has more depth than the outer area since the magnet is annular. Pawn 22 bottom edge 23 and the adjacent base portion is sized and shaped to fit into area 47, with its outer diameter fitting tightly against the cap along the inner edge of annular magnet 41. In an example the queen and king are the outside piece in each stack and rest on the vertical outside upper edge 43 of the nickel plated steel base 42 rather than the cap. FIG. 4 illustrates the bottom edge 13 of queen 14 on edge 43. The bottom edges 17, 19, and 21, respectively, of bishop 16, knight 18, and rook 20 are nested inside of the queen and resting on the cap where it sits on magnet 41. Alternatively the king and queen could rest on the cap. Or there could be no cap and pieces could rest on the magnet or on a thin decorative covering on top of the magnet. The magnetic force is directed up towards the lower edges so the queen and king are magnetically drawn to the base, not the cap above the magnet.

The pole directions of the two bases are opposite (one has magnetic north at the bottom and the other has south at the bottom) so that the bases are magnetically drawn together to create the barrel 50, FIGS. 5A and 5B, consisting of nests 32 and 30 held together back-to-back. In another example there can be a single double-sided magnetic base that holds one team on one side and the other team on the other side. In another example the base can include mechanical features to which the bottom pieces are coupled rather than (or in addition to) the magnetic coupling.

Figures 7A, 7B:
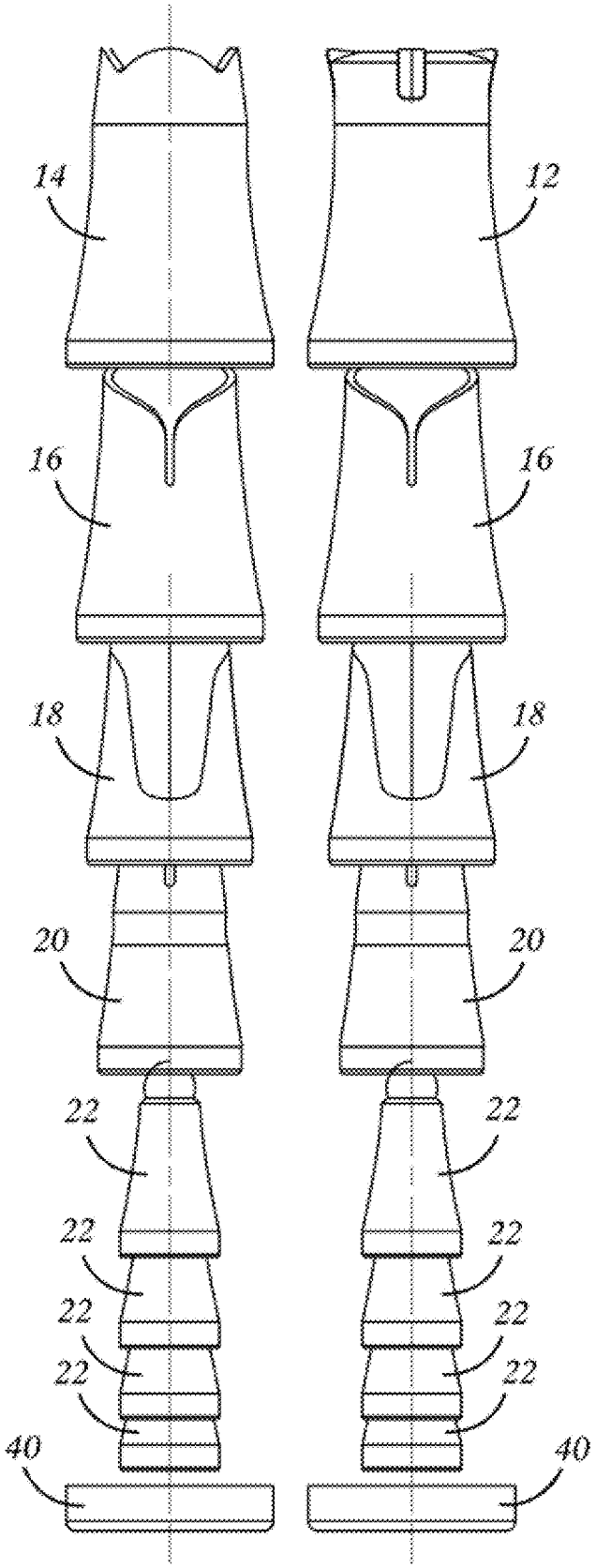
FIGS. 7A and 7B are exploded views of the two stacks for a team.

FIGS. 5A and 5B show a barrel 50 consisting of the two stacks 30 and 32 for a team magnetically held together back-to-back. FIG. 5A is an external view and FIG. 5B is a cross-sectional view (which is the same as the stacks of FIGS. 3A and 3B, placed back-to-back). The two stacks are shown in exploded views in FIGS. 7A and 7B.

Figure 6A:
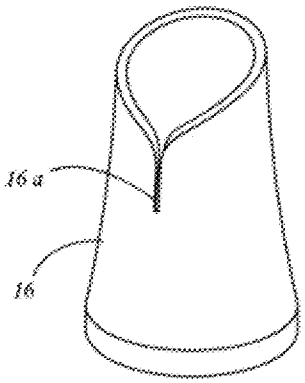
FIGS. 6A and 6B are front perspective views of the bishop and knight, respectively.
Figure 6C:
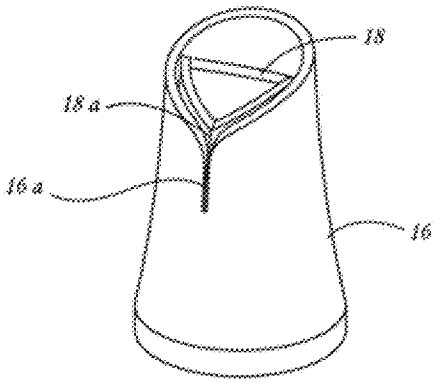
FIG. 6C is a perspective view of these two pieces nested, with the knight inside of the bishop.
Figure 6B:
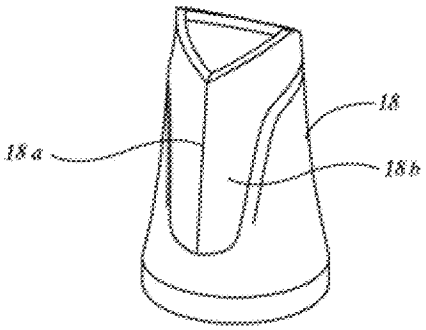

In an example the bishop and knight are configured such that they stay aligned and do not rotate relative to one another when they are nested. See FIGS. 6A-6C. This is accomplished in part by creating a projecting "nose" 18*a* on knight 18 that fits closely inside of the projecting front crease 16*a* of bishop 16. Further, in an example in the knight and bishop the cross-sectional wall thicknesses are not the same in the x and y (orthogonal) dimensions. This helps these two to nest in only one orientation. Also, in an example the flat portions 18*b* along both sides of nose 18*a* of knight 18 are configured to index with the inside wall of the bishop, where the portion of the bishop's inside wall that is so indexed are offset to create a slight cavity in which flat portions 18*b* rest. In addition to nose 18*a* resting against the inside of crease 16*a*, the flat portions 18*b* are parallel to the inside wall of the bishop to prevent the knight from rotating inside of the bishop and keep it aligned inside the bishop.

A number of implementations have been described. Nevertheless, it will be understood that additional modifications may be made without departing from the scope of the inventive concepts described herein, and, accordingly, other examples are within the scope of the following claims.

What is claimed is:

1. A nesting chess set, comprising:

two teams of chess pieces, wherein each team comprises one king, one queen, two rooks, two bishops, two knights, and eight pawns;

wherein the pieces of each team are configured such that they can be organized into two nests, each nest comprising eight pieces, wherein the only difference between the two nests is that one has the king and one has the queen, while otherwise each nest has a rook, a bishop, a knight, and four pawns;

wherein the queen is the outside piece of one nest, the king is the outside piece of the other nest, and the rest of the pieces are sized and shaped to nest within the king or queen; and wherein each nest is held together by a magnetic base and the magnetic bases of the two nests are configured such that they attract to each other such that the two nests are configured to be held together end-to-end in a generally tubular team shape.

2. The nesting chess set of claim 1, wherein inside of the king and queen the pieces are nested in the following order from outside to inside: one bishop, one knight, one rook, and four pawns.

3. The nesting chess set of claim 1, wherein each piece has a generally conical shape, with an open base and either an open or closed top, wherein the conical shapes are constructed and arranged such that the pieces nest together.

4. The nesting chess set of claim 1, wherein a nest is configured such that the bottoms of the bases of the king or queen, the bishop, the knight, and the rook, are all generally coplanar.

5. The nesting chess set of claim 4, wherein the nest is configured such that the bottom of the base of one pawn sits below the plane in which the bottoms of the bases of the king or queen, the bishop, the knight, and the rook sit.

6. The nesting chess set of claim 1, wherein the four pawns are stacked one on top of another and the stack of pawns sits in part inside of the rook, with the bottom of the base of the innermost pawn located lower than the bottom of the base of the rook.

7. The nesting chess set of claim 1, wherein the magnetic base comprises a permanent magnet at least partially encased in a shell made of a ferromagnetic material, wherein the magnet is annular and the shell is cup shaped.

8. The nesting chess set of claim 7, wherein the bottoms of the bases of the king or queen, the bishop, the knight, and the rook are configured to sit on or just above a top surface of the magnet, and wherein the base of the innermost pawn sits inside of the magnet annulus.

9. The nesting chess set of claim 8, wherein a metal cap covers the top of the magnet and the exposed part of the shell inside of the magnet's annulus.

10. The nesting chess set of claim 9, wherein the bottom of the base of the lowermost pawn is configured to sit on the metal cap.

11. The nesting chess set of claim 10, wherein the shell and cap are configured to touch, to thereby act as a magnetic circuit to help keep the magnetic field primarily in the shell and cap.

12. The nesting chess set of claim 11, wherein the king or queen is configured to sit directly on the top outer edge of the shell, the bishop, knight and rook are configured to sit directly on the cap directly above the top of the magnet, and the innermost pawn is configured to sit directly on the cap on the inside of the magnet's annulus.

13. The nesting chess set of claim 1, wherein the magnetic base is generally circular.

14. The nesting chess set of claim 13, wherein the magnetic base comprises a generally annular magnet.

15. A nesting chess set, comprising:

two teams of chess pieces, wherein each team comprises one king, one queen, two rooks, two bishops, two knights, and eight pawns;

wherein the pieces of each team are configured such that they can be organized into two nests, each nest comprising eight pieces, wherein the only difference between the two nests is that one has the king and one has the queen, while otherwise each nest has a rook, a bishop, a knight, and four pawns;

wherein the queen is the outside piece of one nest, the king is the outside piece of the other nest, and the rest of the pieces are sized and shaped to nest within the king or queen;

wherein each nest is held together by a magnetic base; and wherein a nest is configured such that the bottoms of the bases of the king or queen, the bishop, the knight, and the rook, are all generally coplanar and the nest is further configured such that the bottom of the base of one pawn sits below the plane in which the bottoms of the bases of the king or queen, the bishop, the knight, and the rook sit.

16. A nesting chess set, comprising:

two teams of chess pieces, wherein each team comprises one king, one queen, two rooks, two bishops, two knights, and eight pawns;

wherein the pieces of each team are configured such that they can be organized into two nests, each nest comprising eight pieces, wherein the only difference between the two nests is that one has the king and one has the queen, while otherwise each nest has a rook, a bishop, a knight, and four pawns;

wherein the queen is the outside piece of one nest, the king is the outside piece of the other nest, the rest of the pieces are sized and shaped to nest within the king or queen, the four pawns are stacked one on top of another, and the stack of pawns sits in part inside of the rook, with the bottom of the base of the innermost pawn located lower than the bottom of the base of the rook; and wherein each nest is held together by a magnetic base.

17. A nesting chess set, comprising:

two teams of chess pieces, wherein each team comprises one king, one queen, two rooks, two bishops, two knights, and eight pawns;

wherein the pieces of each team are configured such that they can be organized into two nests, each nest comprising eight pieces, wherein the only difference between the two nests is that one has the king and one has the queen, while otherwise each nest has a rook, a bishop, a knight, and four pawns;

wherein the queen is the outside piece of one nest, the king is the outside piece of the other nest, and the rest of the pieces are sized and shaped to nest within the king or queen; and wherein each nest is held together by a magnetic base that is generally circular and comprises a generally annular magnet.

* * * * *